United States Patent [19]

Thomanek

[11] 4,051,763

[45] Oct. 4, 1977

[54] ARMAMENT SYSTEM AND EXPLOSIVE CHARGE CONSTRUCTION THEREFOR

[75] Inventor: Franz Rudolf Thomanek, Landkreis Schrobenhausen, Germany

[73] Assignee: Messerschmitt-Bolkow-Blohm Gesellschaft mit Beschrankter Haftung, Munich, Germany

[21] Appl. No.: 512,039

[22] Filed: Dec. 2, 1965

[30] Foreign Application Priority Data

Dec. 11, 1964 Germany ..... 978036

[51] Int. Cl.[2] ..... F41H 11/06

[52] U.S. Cl. ..... 89/36 R; 89/36 C; 89/36 H; 89/41 L; 102/24 HC; 109/37; 250/222 R

[58] Field of Search ..... 89/36, 36.55, 36.8, 89/41.62, 41.7 L, 41.7 R, 1 A, 1 M, 28, 28.2; 109/36, 37; 250/220, 578, 222; 102/8; 340/323 R

[56] References Cited

U.S. PATENT DOCUMENTS

| | | | |
|---|---|---|---|
| 469,971 | 3/1892 | Martin | 109/37 |
| 538,968 | 5/1895 | Jackson et al. | 109/36 |
| 1,195,042 | 8/1916 | Leon | 89/36 |
| 1,603,097 | 10/1926 | Wright | 89/36 |
| 2,099,764 | 11/1937 | Touceda | 89/41.7 L |
| 2,113,899 | 4/1938 | Oram | 89/41.7 L |
| 2,473,893 | 6/1949 | Lyle | 89/41.7 R |
| 2,639,770 | 5/1953 | Huber | 102/24 HC |
| 3,242,286 | 3/1966 | Stegbeck, et al. | 102/22 |

FOREIGN PATENT DOCUMENTS

| | | | |
|---|---|---|---|
| 355,773 | 1931 | United Kingdom | 109/37 |

*Primary Examiner*—Stephen C. Bentley
*Attorney, Agent, or Firm*—Toren, McGeady and Stanger

[57] ABSTRACT

A protective armament or intercept system includes a plurality of explosive charges arranged in a grid pattern in spaced parallel relationship to a grid sensing pattern formed by intersecting light sources each of which are aimed at respective photoelectric cells. The light sources and the photoelectric cells form a protective and sensing field with intersecting points which are in alignment with respective explosive charges and when the light sources at an intersecting point are broken, the receiving photoelectric cells for the broken light sources will be influenced so as to ignite the charge which is in alignment with the broken intersection point of the light sources. The construction of a preferred explosive charge and the various preferred arrangements of the explosive charges in respect to the sensing pattern formed by the photoelectric cells and light sources are set forth and described in respect to the protection of an aircraft hanger and a movable vehicle such as a tank by way of example.

17 Claims, 11 Drawing Figures

Fig.: 1
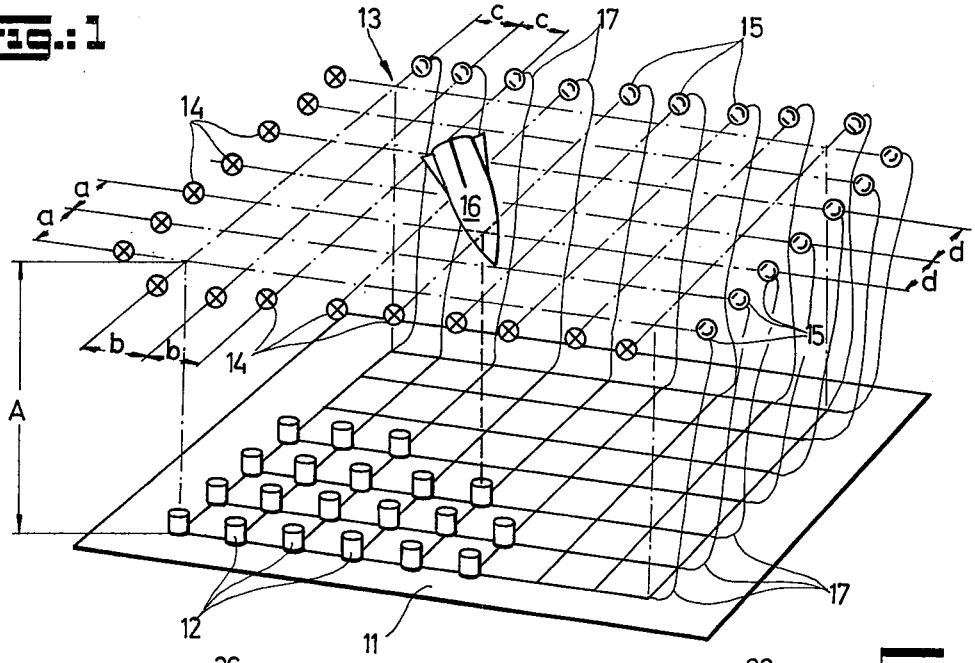
Fig.: 2
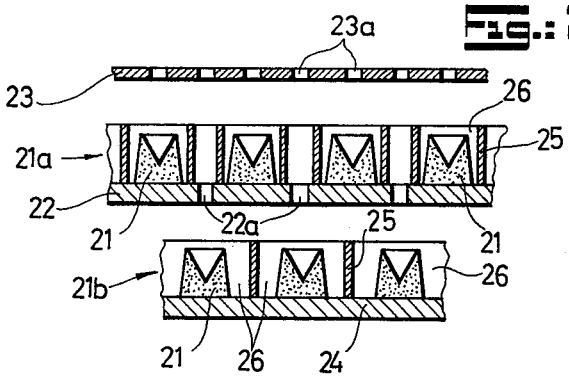
Fig.: 3
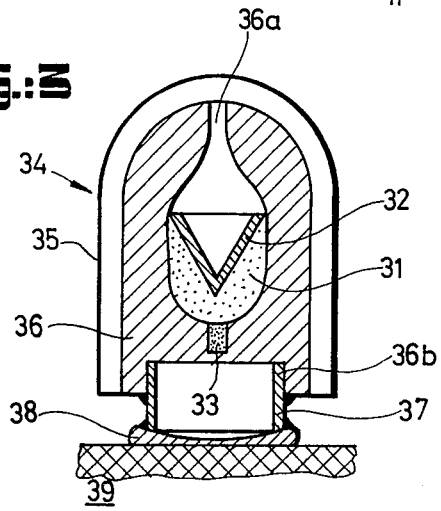
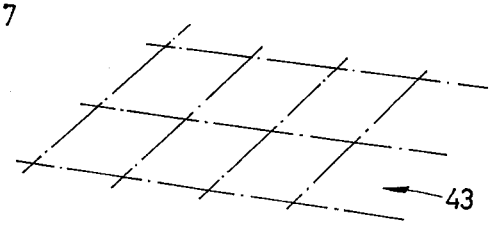
Fig.: 4
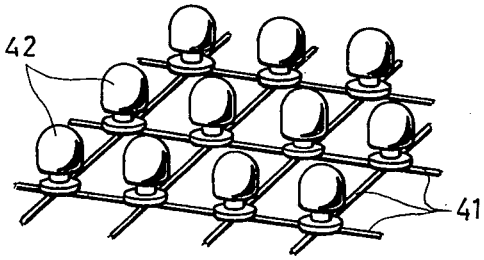
INVENTOR
Franz Rudolf Thomanek
By Mulglow and Torrey
ATTORNEYS INVENTOR
Franz Rudolf Thomanek By Mulholland and Orkin
ATTORNEYS INVENTOR
Franz Rudolf Thomanek By Mulcahy and Torrey
ATTORNEYS INVENTOR
Franz Rudolf Thomanek By Mulholland and Torrey
ATTORNEYS INVENTOR
Franz Rudolf Thomanek By Wolcott and Torrey

ATTORNEYS

INVENTOR
Franz Rudolf Thomanek

By Wolfgang and Torsten

ATTORNEYS

ARMAMENT SYSTEM AND EXPLOSIVE CHARGE CONSTRUCTION THEREFOR

SUMMARY OF THE INVENTION

This invention relates in general to a protective armament or intercept system, and in particular to a new and useful protective arrangement for a fixed or movable fortification for effecting a premature explosion of an attacking missile or projectile so as to prevent major damage to the fortification.

This invention provides a protecting arrangement for stationary or movable targets, such as, for example, small fortifications, bunkers, dugouts, subterranean shelters, land vehilces, water vehicles and the like, and even possibly for air bodies. The inventive protecting arrangement is designed to protect such targets from destruction by exploding warheads or projectiles such as bombs, rockets, missiles, etc. It accomplishes this by destroying such projectiles prior to impact on the target by means of intercepting explosive charges.

Prior to the present invention it has been suggested to provide fortification such as ships, for example, with means such as helicopters, balloons or the like for suspending a protective screen around the vessel, or even for carrying explosive charges at a location at which they will be detonated before penetration by an opposing vessel such as another ship or aircraft. A disadvantage in such equipment, however, is that they have a small hit probability and relatively negligible effect. In addition, they cannot be used when there is insufficient visibility. They require extensive expenditure from a technical point of view so that their use can only be considered practical for protecting of relatively large targets. Other systems such as electronically operated flying missile screens have the disadvantage that they require tremendous technical expenditure and have a certain control inertia so that the use of such anti-weapon systems against smaller projectiles such as bombs is not intended and from a practical point of view probably not feasible. In those systems which must be fired from the ground, there must be early recognition of the penetrating enemy projectile and a fast reaction of the operating personnel and great exactness in aiming in order to obtain an effective defense.

In accordance with the present invention there is provided an intercept system which is particularly applicable for smaller targets such as small fixed fortifications or movable vehicles such as tanks. The system of the invention does not have the disadvantages of known protective arrangements and requires only minimum of technical expenditure but is still fully effective against any kind of enemy projectiles including bombs, rockets or the like which move in a speed range of from 50 to 1200 meters per second in the vicinity of the target and pentrate the protecting area either from above or from the side. While the protective arrangement is particularly applicable for small size areas such as movable mobile units, it may be also applied for relatively large targets such as bunkers, battle ships, etc.

In accordance with the invention there is provided a protective system which advantageously includes a grid or network comprising a plurality of explosives arranged in a fixed pattern with light ray or other energy sensing means arranged in a pattern corresponding thereto but at a speed location outwardly from the target and from the explosives.

The sensing means form interceptin lines which correspond to the location of the projections of the firing lines of the selected explosives and which are connected to a firing mechanism for the explosives to effect firing when the light rays are interrupted by an incoming projectile or bomb.

The protective arrangement is not designed to completely protect the target or fortification to be protected. The system is designed to prevent destruction of the target to such a degree that its tactical use is not in danger. This requires, therefore, that the target itself be protected to some degree so that the armor will be able to withstand smaller enemy projectiles and any debris which may fall on the vehicle as a result of the explosion of larger ones. The intercept system light sensing means is advantageously designed so that it will not effect the firing of an explosive charge for relatively small sized projectiles which cannot harm the fortification being protected. Therefore, release of the actuating means associated with the explosive charges can only be effected by an incoming projectile when the amount of interrupted individual light rays of the light barrier exceeds a predetemined value.

Instead of light sensing means, radiation sensing means may be employed for triggering the explosive charges. The sensing means are arranged such that an incoming projectile will intercept and actuate sensing means aligned for triggering an explosive charge which is in direct alignment with the projectile. The spacing of the hollow charges is determined by the caliber and the type of the projectile or bomb to be intercepted. The explosion of the hollow charge is designed to take place early enough so that the ray or thorn formed by the explosion of the charge will be fully active and cause a far-reaching destruction of the incoming enemy projectile. For this purpose, and according to a further feature of the invention, the sensing means are usually arranged from the plane of the hollow explosive charges at a distance of from 5 to 20 times the caliber diameter of the hollow explosive charge. By the explosion of the hollow charge the destruction effect of the intercepted bomb or missible is materially reduced, but the target to be protected must possess sufficient inherent resistance capability so that it can withstand the different residual effects of the destroyed projectile. Thus, the protective system must be designed not only for the target which must be protected, but also the kind of enemy projectile to be intercepted and the expenditure of the protective arrangement has to be in a suitable relationship to the target to be protected. This expenditure is about inversely proportional to the quadrate of the smallest caliber of the enemy projectiles which can still be embraced by the radiation barrier.

Since the protective arrangement may be subjected to the action of falling rock or other debris emanating from a remote exploding projectile which may trigger the explosive charges of the protective system, it is necessary that the ignition system for the explosive charge be such that explosion thereof will not take place unless a projectile enters the sensing means at a speed for example in excess of 50 meters per second. It is also necessary to insure that such things as overhanging branches etc. will not affect the system. In addition, it is also essential that the explosive charges be such that they will not explose after an initial enemy projectile is exploded in the vicinity. To insure that this will not occur, means are provided for disconnecting the entire igniting system for the remaining charges for a short period, for example several milliseconds, after the explosion of the incoming enemy projectile occurs.

Accordingly, it is an object of the invention to provide an interceptor system for the protection of fortifications.

A further object of the invention is to provide an interceptor system which is extremely versatile and which includes means for triggering the detonation of explosive charges in the vicinity of an incoming enemy projectile or missile for the purpose of exploding the missile before it reaches the target.

A further object of the invention is to provide an inexpensive and easy to install system for protecting particularly small fortifications such as a moving tank, for example, wherein the system advantageously includes a grid with sensing means arranged in alignment with explosive charges or a projection of their firing linesand which are equally spaced along the grid for the purpose of igniting an explosive charge when a projectile of a particular size enters the sensing means.

A further object of the invention is to provide a protection system which includes means for exploding an explosive charge for the purpose of intercepting and detonating an incoming enemy projectile before it completes its flight path to a target and wherein the system is selectively actuated only on an inflight of a projectile of a particular size.

A further object of the invention is to provide a protective system for destroying enemy projectiles and the like before they approach a target area which is simple in design, rugged in construction and economical to manufacture and may be installed in association with large or small fortifications and even moving vehicles such as a tank.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there are illustrated and described preferred embodiments of the invention.

In the drawings:

FIG. 1 is a somewhat schematic perspective view of a protective arrangement constructed in accordance with the invention;

FIG. 2 is a partial sectional view of an explosive charge installation for the protective arrangement of the invention;

FIG. 4 is a view similar to FIG. 1 of another embodiment of the invention;

FIG. 8 is a perspective view of an airplane hangar having the protective system constructed in accordance with the invention;

Figure 5:
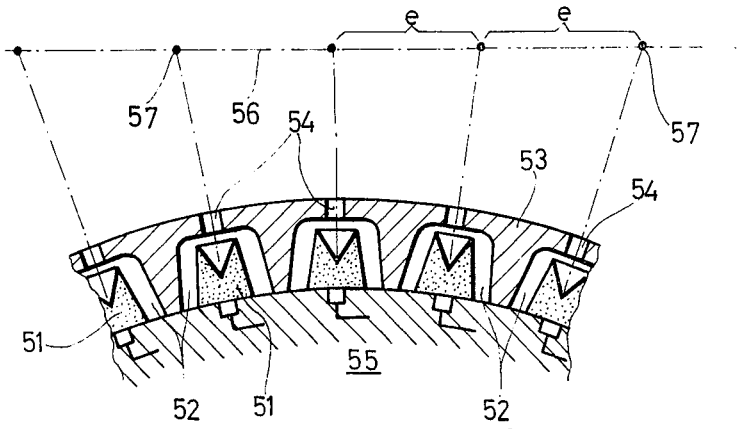
FIG. 5 is a partial sectional view of a "honey-comb" plate having explosive charges therein.

Referring to the drawings in particular, the invention embodied therein in FIG. 1 comprises a surface 11 which is protected by a system constructed in accordance with the invention. The system includes a plurality of explosive charges 12 which are mounted above the surface 11 in a grid pattern at a spacing which will provide the best protective arrangement for the surface 11. The direction of action of these charges 12 is such that it points away from the target 11 to be protected.

In accordance with a feature of the invention, sensing means are arranged at a distance A away from the explosive charges 12 for the purpose of initiating the explosion of these charges only upon the entrance or a warhead or projectile 16 of a certain predetermined size. In the embodiment illustrated, the sensing means includes explosive charge firing actuating means for each charge 12 formed by a photoelectric cell light grid arrangement corresponding to the grid arrangement of the explosive charge 12. Light sources 14 are directed toward opposing photocells 15 and the intersections of the light beam from these sources emanating from cross side and end positions are advantageously selected to overlie the intersection of the axes of the placement of the explosive charges 12. The light ray barrier 13 which is formed is advantageously arranged in a plane substantially parallel to the plane of arrangement of the hollow explosive charge 12. The spacing between the individual light sources 14 is indicated by a for one side and b for one end and the spacing between the photocells is indicated c for one end and *d* for the adjacent side. This spacing is such that at least two vertically intersecting grid lines formed by the intersections of the light rays are cut by the projectile 16 to cause an interruption of an electrical circuit (not shown) for actuating the firing of the charges 12. The connection between the photocells and the circuit (not shown) is made by wires 17. One hollow charge 12 is associated with the intercepting point of two grid lines or light rays of the light ray barrier 13.

The charge firing system (not shown) is of a well known type but advantageously includes means for exploding a charge at a location on a grid pattern adjacent the surface to be protected 11 which corresponds to the intersection of two light beams in the similar pattern vertically thereabove at the light grid formation 13. Actuation of one of the explosive charges causes a disruption of the electrical supply to all of the other charges so that they will remain inoperative or blocked. In this manner it will be assured that no large gaps will occur in the charge arrangement because of the explosion of more than one charge. It is not likely that several projectiles will strike at the same area and at the same time, and the protecting device remains intact in the remaining regions and thus is ready to fire in these areas.

In some instances the wires 17 are connected to control means which effect the firing of more than one charge 12 at a time. This will also occur when two or more intersecting rays are interrupted. In some instances it is desired that the charges 12 fire in parallel arrangement, and in other instances it has been found more desirable to align them so that the charges will be fired to intersect at a common point corresponding to the location of the incoming projectile, for example.

It should be appreciated that although the sensing means grid pattern 13 is indicated as being light sources and photocells, it should be understood that it may comprise radiation sources and radiation receivers. It is desirable that the rays be concentrated in a sufficiently sharp manner and arranged in a distance and grid pattern which is set in accordance with the type of target to be protected. The radiation source may for example radiate visible light rays or ultraviolet light, ultrared light or light of particular frequencies and as well as thermic rays. The choice of the particular kind of radiation source will be largely dependent on the specific requirement determined by the tactical viewpoints and by the nature of the target to be protected.

Various factors are used on determining the grid pattern 13 and the spacing of the intersecting light rays. The inherent or natural capabilities of resistance of the target to be protected, the size of the projectiles being intercepted, the nature of these projectiles, that is, whether they are explosive projectiles or hard core projectiles, and in particular the after-effect which may be expected with certain projectiles after destruction of the projectile at a distance from the target, are all factors to be considered in determining the distance between the individual grid lines of the sensing means. For example, if an explosive projectile to be expected has a small caliber and a relatively large residual action after destruction, then with a small inherent resistance capacity of the target the distance A of the light ray barrier from the plane of arrangement of the intercepting charge (which in accordance with the invention should correspond to from 5 to 50 times the caliber diamter of the hollow charge) will be correspondingly large while a grid distance between the intersecting light rays will be corresponding small. By contrast with larger strongly armored targets with which the destruction probability is only present if they are attached by large caliber projectiles, the grid element distance can be chosen at a greater amount. The effect of the protective arrangement, however, finds its limitation with the use of extremely large caliber projectiles whose overdimensioned residual action in spite of timely interception between the blocking plane and the arrangement plane of the hollow explosive charge would nevertheless cause destruction of the target. Such ineffectiveness of the protective devices is, however, only based on theoretical assumption, while from a practical point of view the use of such large caliber projectiles cannot reasonably be expected.

In prior art proposed solutions for interception of enemy targets complicated calculation has to be effected as, for example, in the determination of the trajectory, the determination of collision time and collision point. With the present invention any calculation is limited to determining the position where the trajectory of an enemy projectile will penetrate the plane of the radiation barrier 13. The calculation of the collision point and of the corresponding ignition time, however, is unnecessary. The construction of the radiation blocking plane 13 with the blocking rays in the surface coordinates $x$ and $y$ permits a direct connection of the energy receivers or photocells with the intercepting charges 12 which are arranged according to the same coordinate system. Since the electronic formation of the igniting signal to the charges 12 and the flying time of the hollow explosive charge ray up to the blocking plane amounts to only several microseconds, the speed of the enemy projectile need not be considered in the calculation since within this time period it will advance only a few millimeters on the trajectory. Because of this practically delay-less ignition of the intercepting charge and its high speed, the distance A in FIG. 1 of the hollow charges 12 from the plane of the intersecting points of the sensing means 13 need not be of equal magnitude in all instances. An example of this will be indicated with respect to FIGS. 6 and 7 which will follow hereinafter.

An important feature of the inventive construction is that means must be provided to make sure that the hollow charges 12 which are not ignited by the penetration of a projectile 16 into the sensing means field do not become unintentionally ignited by the detonation pressure waves caused by the explosion of the projectile 16. According to a further feature of the invention the hollow explosive charges are arranged behind a protective plate (not shown in FIG. 1). The plate is of a thickness and of a material composition so that destruction of the hollow charge system situated behind the plate or the unintentional release of individual charges is effectively prevented.

According to a further embodiment of the above feature as indicated in FIG. 2, hollow charges 21 are arranged in several layers **21*a* and 21*b*, one behind the other, and in an offset manner. Each layer is separated and protected by the following one and by a protecting plate 22 arranged between the layers. The protecting plate 22 acts as a carrier plate for the hollow explosive charges. The plate 22 is provided with shooting channels or passages 22*a* which are opened in the direction of action of the hollow explosive charges. The charges 21 in the layer 21*b* are fired through the passages 22*a*. The first layer 21*a* of the intercepting charges 21 is protected by a plate 23 having shooting passages 23*a* for the two layers 21*a* and 21*b*. The shooting channels or passages 23*a*** are sufficiently large so that the solid matter or thorn which is formed by the lining of the hollow charges can pass through the passages without obstruction.

As shown in FIG. 2, the individual hollow explosive charges 21 are separated by separating walls 25. The charges are contained in individual compartments 26 formed between the separating walls 25. In this manner the charges are further protected against unintentional ignition caused by detonation of another charge. In addition, the charges are protected by known ignition technical measures which have not been shown. The separating walls 25 form together with the plates 22 and 24 rectangular boxes which are opened in the direction of action.

If a protecting arrangement having several layers of intercepting charges are arranged one behind the other, then the distance of the last layer or layers from the blocking plane or sensing plane 13 should not be too great. This is to insure that the hollow charge ray or thorn which is formed upon explosion will not lose its compact form and disintegrate upon increasing distance from the target into small individual splinters and cause a weakening or even total loss of the effect of the charge. In order to effect this and to obtain full effect of the individual layers when the intercepting charges are arranged in layer formation, the invention provides in accordance with a further feature that each layer of the hollow explosive charge is associated with its own radiation barrier to cause the ignition thereof. The blocking of the rays is thus arranged in a number of planes corresponding to the layers of charges and a distance of each layer from the associated barrier plane is chosen so that in the collision point to be expected the optimum hollow charge effect will take place.

In the same manner as in the embodiment of FIG. 1, the embodiment of FIG. 2 provides for one intercepting charge or several intercepting charges which may be simultaneously ignited upon penetration by an enemy projectile. For example, one hollow charge of each of the layers may be released upon such penetration. The individual charges, in order to increase the efficiency of the protecting device, may be aligned either toward a common intersecting point of protective grid 13, or, in order to obtain a larger surface action, they may be aligned with several adjacent intersecting points. In addition, the arrangement may be such that the charges are fired either at the same time or one after the other in succession. In the FIG. 2 arrangement, the charges are arranged in a very tight formation in order to insure effective protection. This arrangement may be necessary for very small targets. However, if the purpose is to protect a target of relatively large surface area from destruction, as for example from a large caliber projectile such as a bomb, then the protective arrangement of FIG. 2 would be rather expensive.

Figure 3:
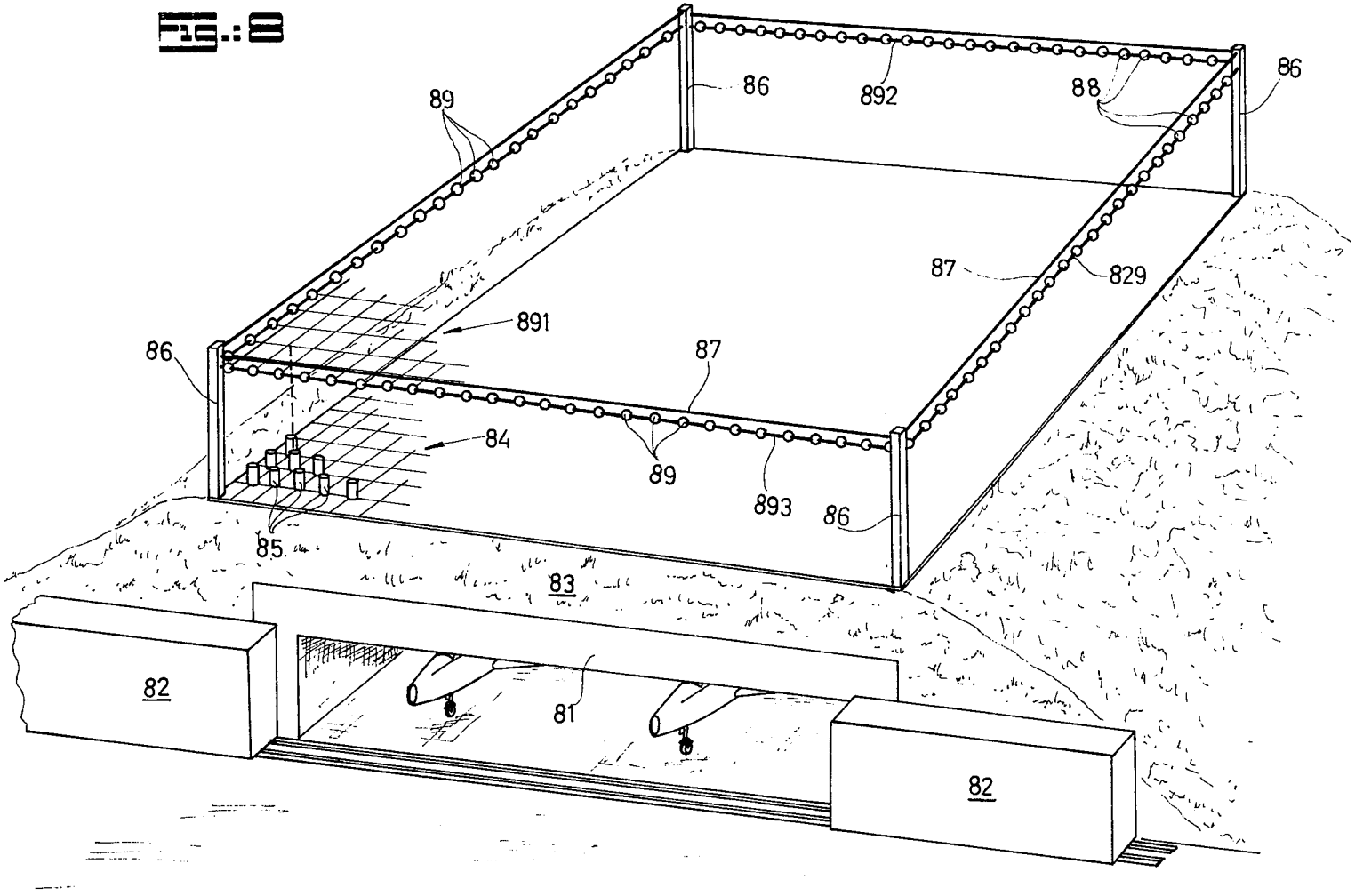
FIG. 3 is a longitudinal sectional view of an intercepting charge mounted on a target to be protected.

For large targets, the arrangement of FIG. 3 is recommended which includes a mounting plate 39 on which are mounted a plurality of explosive charges which are accommodated in their own protective bodies 34. Each charge consists of an explosive body 31, a hollow charge lining 32 and an igniter 33. The protecting body 34 comprises an outer thin-walled cover 35 which performs a task of protecting a charge against water influence and consists of an inner strong-walled protecting body or casing 36 which is not decomposed upon detonation of a charge 31 and offers the charge sufficient protection against the action of projectiles or parts thereof which penetrate through the barrier system or sensing means 13 and also protection against the detonation pressure wave action from the explosion of a penetrating projectile 16. The inner protective body 36 is provided with an opening or shooting passage 36*a* extending in a direction of action of the hollow explosive charge. The size of the channel 36*a* is chosen to adequately accommodate the hollow explosive ray or thorn which will be formed by the lining of the charge upon explosion. The inner protective body 36 is provided at its lower end with a recess 36*b* into which there is fitted a pipe or tube 37. The pipe 37 and the protecting body 36 are welded to each other, and the other end of the pipe 37 stands on a ball member or dome 38 which is secured to the object to be protected 39 such as by welding. The pipe 37 supports the charge 34 pivotally on the ball dome 38 which offers means for an exact and easy alignment for aiming of the explosive charge axis to the associated crossing or intersecting points of the barrier rays. After such alignment, the lower end of the tube or pipe 37 is welded with the ball dome 38 whereby a defined immovable position of the intercepting charge is assured.

The embodiment of FIG. 3 can be used for small targets as well as large surface targets and may, for example, be used for securing an explosive to a tank, for example. As indicated in FIG. 4, explosive charges 42 similar to explosive charges 34 are mounted on a carrier net 41 which comprises a wire rope with the charges being secured at the reticulations or intersectios of the ropes. A barrier system 43 schematically indicated but similar to the system 13 of FIG. 1 is arranged in spaced relation to the charges 42. By using the net structure 41 which may advantageously be secured, for example, to a mast, it is possible to use the device without significantly obscuring vision. This is particularly important in respect to ships and similar targets. If only small objects are to be protected, however, sufficient unobstructed vision or view is also important, and instead of on a net the charges may be secured on a rigid carrier grid.

In FIG. 5 there is indicated a variation of the arrangement of FIG. 2 in which hollow explosive charges 51 are arranged in a one-piece plate construction 53 having honeycomblike cells or depressions 52. The plate 53 advantageously comprises a material which is sufficiently resistant to the explosive action of adjacent explosives 51 and against the action of splinters and detonation pressure waves caused by the destruction of an enemy projectile. In order to permit the exit of the hollow charge thorn, openings 54 are provided in the plate 53. The curvature of the plate 53 corresponds to the configuration of the target 55 to be protected. As a result, the shooting lines of the explosive charges 51 indicated by dot and dash lines intersect the intercept plane 54 at collision points 57 having a spacing *e* from each other which increases from the center outwardly. Such increase in distance between successive collision points 57 and the resulting enlargement of the grid of the barrier plane may be of interest, for example, if particularly sensitive portions of the target are located in the center of the protecting device so that a larger effective density is required in the barrier and intercepting system at such location. It is also possible to orient the charges 51 so that the collision points in the intercept plane 56 will be spaced equally apart, if so desired.

Figure 6:
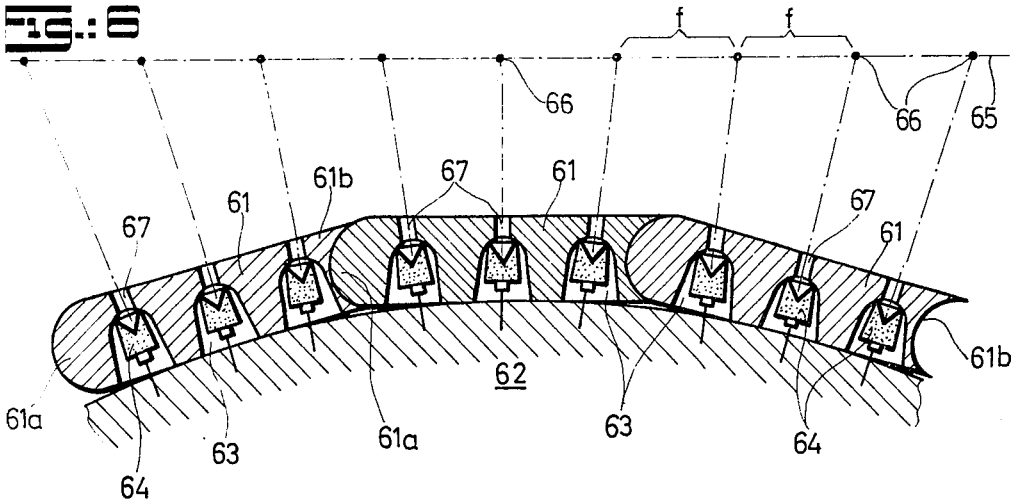
FIG. 6 is a view similar to FIG. 5 of another embodiment of the invention.

In the embodiment of FIG. 5 it is advantageous to form the plates 53 in one piece. However, where this cannot be done, an embodiment similar to FIG. 6 is employed. In this construction several abutting and interengageable plates 61 are arranged to cover the surface of the target 62. Adjacent plates are constructed with complementary convex and concave ends so that they interengage to permit them to be extended around the curved surface which is to be protected. Edges 61*a* are advantageously made convex and they engage in the concave edges 61*b* of next adjacent plates. Hollow charges 64 are arranged in spaces 63 defined in the underside of each plate element 61 and each space 63 is provided with an opening or passage 67 for the shooting of the explosive charges 64. In this embodiment, the hollow charges 64 are aligned so that the intersections of all of the charges with the collision plane 65 are equally spaced from each other.

Figure 7:
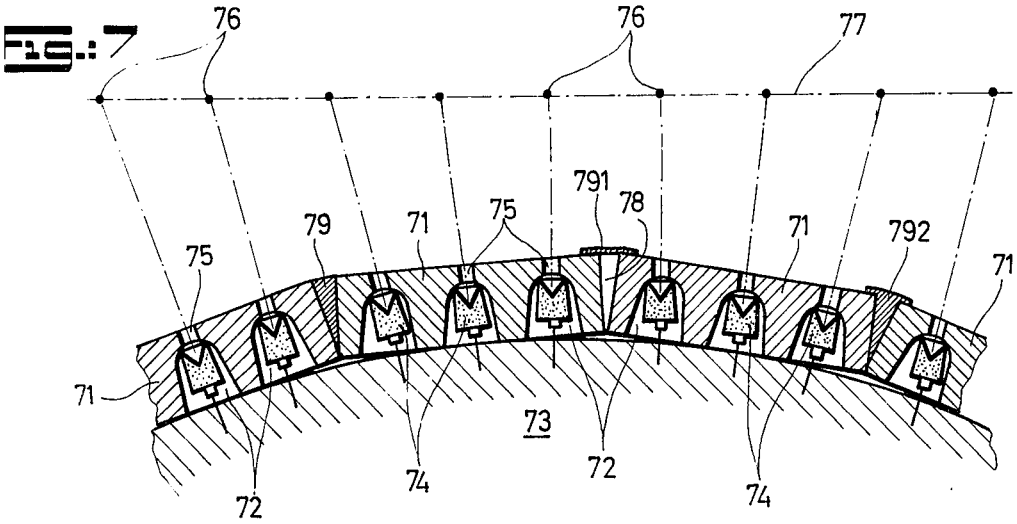
FIG. 7 is a view similar to FIG. 5 of still another embodiment of the invention.

In FIG. 7, substantially rectangular plate elements 71 are provided with conical despressions 72 for receiving hollow charges 74. The plates 71 are draped over the curved surface 73 which is to be protected and form wedge-like interstices 78 at their junction and are welded in position as by weld material as at 79 or covered as at 791 or filled with a filling element 792 having projections at both sides which rest upon the surface of adjacent plates. Each of the plates 53, 61 and 71 of the embodiments of FIGS. 5, 6 and 7 are advantageously made of a material which is not only resistant to mechanical penetration of an exploding projectile but is also impermeable to radioactive radiation or at least resistant thereto.

In FIG. 8 there is indicated an arrangement of the protective system for a subterranean aircraft hangar. It is assumed that the aircraft hangar is to be protected against heavy bomb impact. The hangar includes a concrete ceiling 81 and concrete sliding doors 82. A thick layer of earth 83 is mounded above the ceiling 81 and the sides of the hangar to offer sufficient protection against artillery impact of relatively large caliber and also against small bombs. In accordance with the invention, above the ceiling 81 on the surface of the earth layer 83 intercepting charges 85 are arranged in a grid pattern 84. The grid pattern 84 is dimensioned correspondingly to the bomb type to be intercepted. In addition, the caliber of the hollow explosive charges is adapted to the bomb type to be expected.

Masts 86 are inserted into the ground at four corner posts of the protective shield. Ropes 87 are tensioned between the masts 86 as carriers for a radiation barrier generally designated 891. The radiation barrier 891 is similar to the embodiment in FIG. 1 but includes radiation sources 88 and radiation receivers 89 arranged so that the rays intersect from corresponding side and end radiation sources in the same grid pattern as the arrangement of the hollow charges 85. The spacing of the radiation sources and receivers is chosen so that the rays in the barrier plane yield a grid formation 891 which is coextensive with the grid 84. The radiation sources 88 and the radiation receivers 89 are connected with each other for current supply through lines 892 and 893, respectively. The radiation receivers 89 are connected with an igniting system (not shown) through igniting current lines (not shown) which are drawn into the line cable 893. The arrangement is such that upon entry of an enemy projectile into the scanning or grid field 891 of the radiation barrier, the hollow charges corresponding to the crossing point or points of the rays are ignited.

Figure 9:
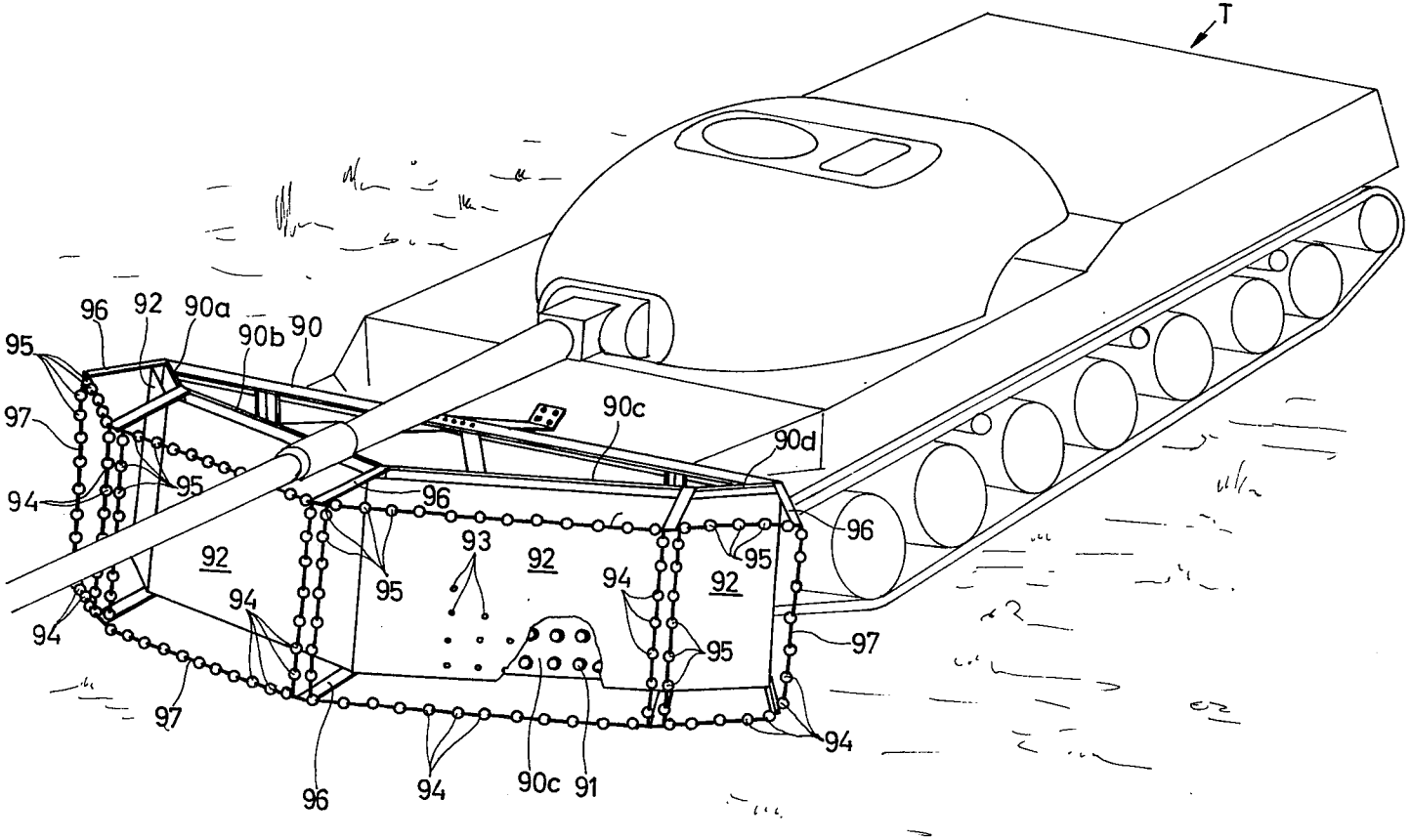
FIG. 9 is a perspective view of a tank having a protective device arranged at the forward end thereof.

In the embodiment of FIG. 9 there is shown a protective device arranged in the front of a tank generally designated T. Assuming that the tank will be primarily subject to impact from the front, the front side, for example below the tower, must be primarily protected. For this purpose a frame construction 90 is secured to the forward end of the tank structure. The plates 90 *a, b* and *c* are secured at the frame construction which is substantially wedge-shaped in plan view. These plates serve as carrier plates for the hollow charges 91. In order to prevent the hollow charges from being destroyed or unintentionally ignited by small projectiles which may penetrate the barrier system or are destroyed by the action of splinters or detonation pressure waves from projectiles intercepted in the barrier plane, protective plates 92 are arranged in front of the hollow charges 91 parallel to the carrier plates 90 *a, b, c* and *d.* These protective plates 92 have shooting passages 93 for the passage of the hollow charge thorn.

A radiation barrier is arranged in front of the intercepting explosive and is formed by light sources 94 and photocells 95. The light sources 94 and photocells 95 are secured to members 96 and line cables 97 in planes which extend substantially parallel to the plates 92. The photocells are connected through guiding lines situated in the cable 92 with an igniting mechanism (not shown) for actuating the intercepting charges 91.

Figure 10:
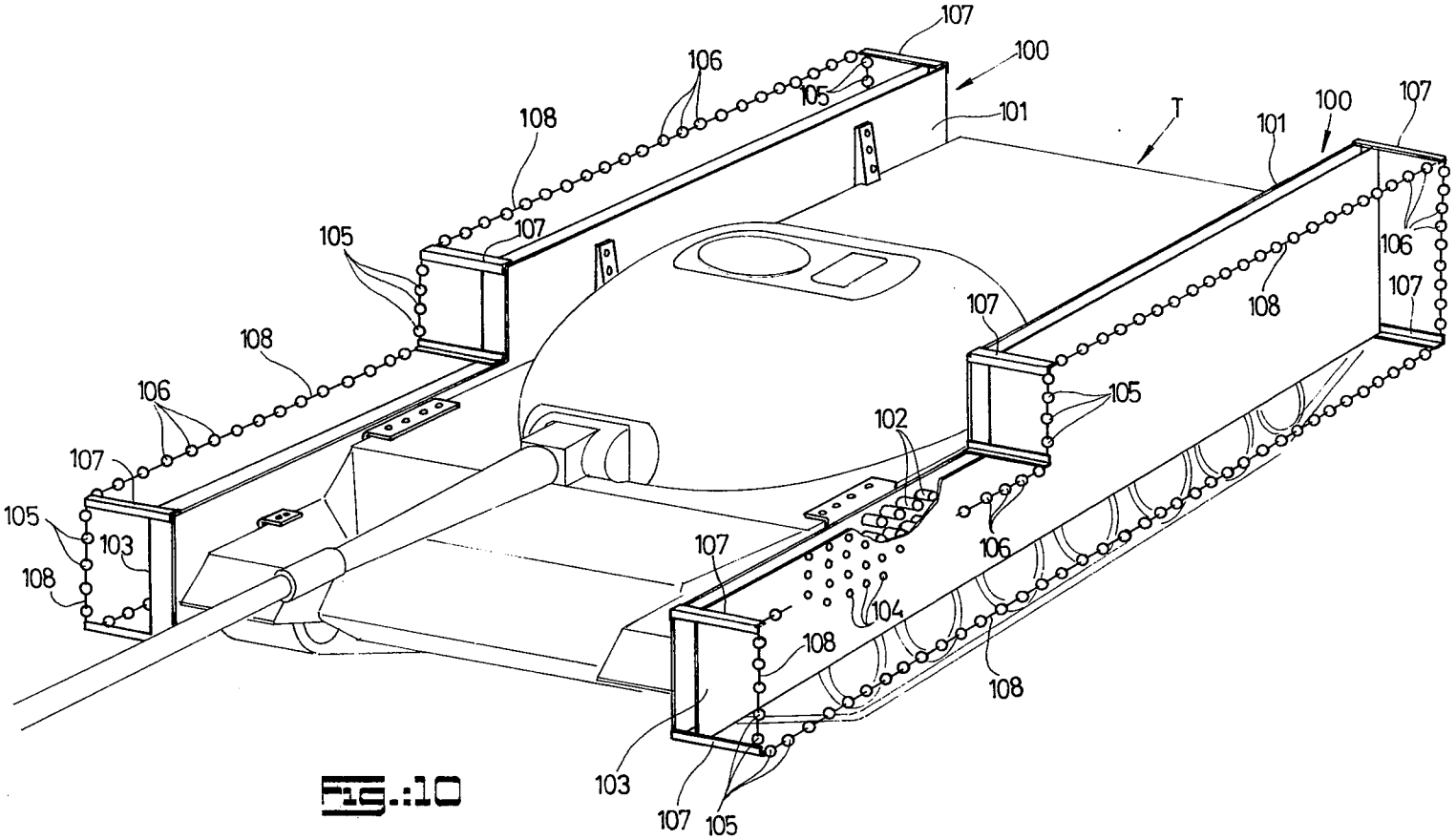
FIG. 10 is a view similar to FIG. 9 with a protective arrangement on a tank for protection against lateral attack.

FIG. 10 also shows a tank T in which the sides are protected by a system constructed in accordance with the invention. The frame construction 100 is arranged on each side for mounting the protecting device on the tank. The frame construction carries a through-going one-piece carrier plate 100 for reception of the hollow explosive charges 102 and also carries a protective plate 103 which is arranged in front of the charges. The plate 103 is provided with shooting passages or channels 104. The light ray barrier is composed of the light sources 105 and photocells 106 in the same manner as in the embodiment of FIG. 9 and is secured at members 107 and line cables 108 parallel to the plane of arrangement of the intercepting charges 102. The spacing of the hollow explosive charges in the grid or scanning distances of the light ray barrier in the embodiments of FIGS. 9 and 10 correspond to those of FIG. 1 and are dependent on the size and kind of the enemy projectile to be expected and are chosen to be so large that a projectile of a size which would destroy the tank upon penetration of the barrier plane will intersect at least two intersecting light rays. Due to the actuation of the light barrier caused thereby, either one of several hollow charges is detonated.

Figure 11:
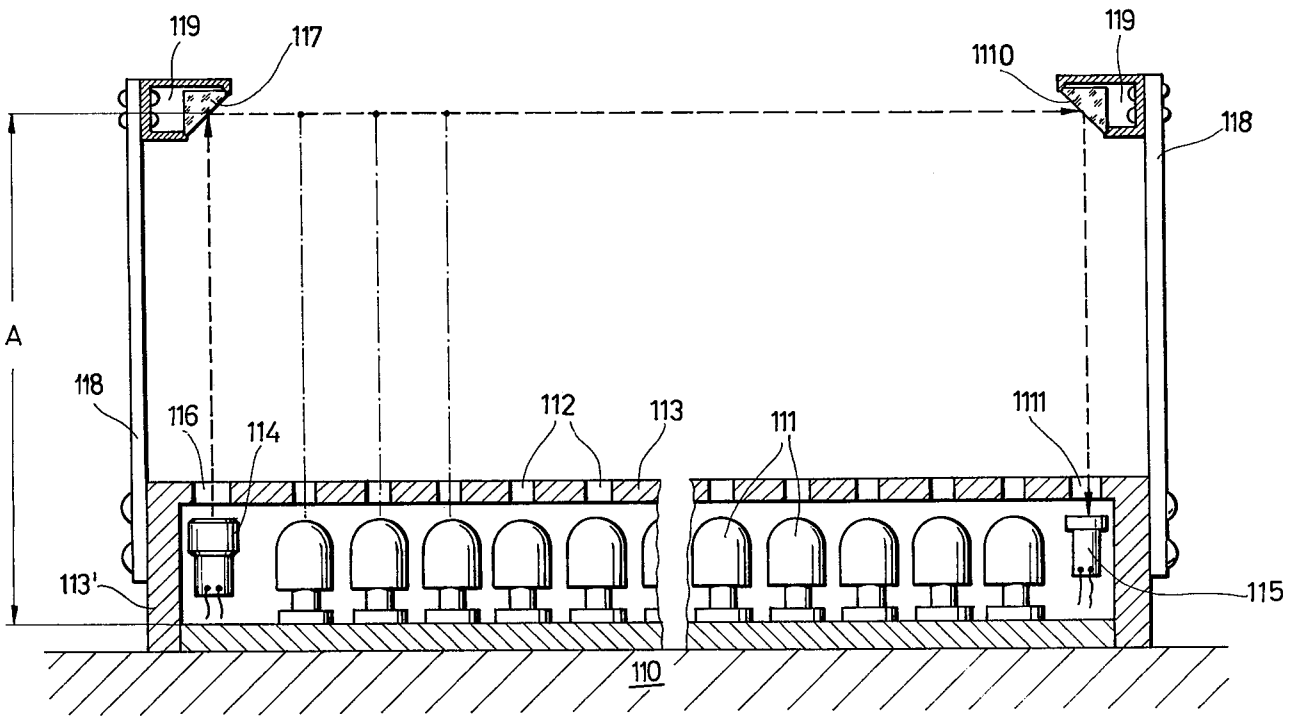
FIG. 11 is a longitudinal sectional view of still another embodiment of protective arrangement.

In the preceding embodiments, the light sources and the photocells and the radiation sources and receivers corresponding thereto have been shown freely situated in front of the plane of the intercepting charges. This has been made in order to facilitate the representation of the device. This arrangement, however, from a practical point of view may not be used in many instances since the radiation sources and receivers are subject to destruction in the same manner as the intercepting charges which are partly arranged behind protective plates. Partial or total inoperativeness of the protecting device would therefore be obtained either by destruction of the individual explosive charges or all of the explosive charges, but also by the inoperativeness of the devices which form the light ray barrier, such inoperativeness may be caused by splinters or detonation pressure waves. In accordance with the invention, however, it is the practice to locate the radiation sources and radiation receivers and the associated igniting device for the release of the hollow charges in an arrangement outside the release plane and in protected positions. In such an arrangement the radiation barrier is formed by deflection of the rays, for example the light rays are deflected by means of mirrors or prisms. In the embodiment indicated in FIG. 11, a preferable arrangement is shown which includes a target 110 to be protected on whose surface the hollow explosive charges 111 are secured behind a protective plate 113. The plate is provided with shooting passages 112 for hollow charges 11 which are also mounted in protective coverings. The front plate 113 and a side plate 113' complete the protection. In addition to the hollow explosive charges light sources 114 and photocells are arranged behind the protective plates and arranged to be emitted by the light sources which exit through the opening 116 arranged in the plate 113 and impinge on prisms 117 carried at the upper ends of arms 118 at a distance A comparable to the spacing of the intercept plane from the explosive charges. The prisms are received in a protected manner in boxes 119 which are secured at the carriers 118. The position and angle of reflection of prisms 117 are calculated so that the rays which emanate from the light source 114 and impinge on the prisms are refracted or deflected about 90° and parallel to the plane of arrangement of the hollow explosive charges and then impinge on prisms 1110 which are arranged in boxes 119 at the other end of the protective arrangement. These prisms 1110 in turn deflect the rays which have been indicated by dash lines by 90°. The rays, at the end of their journey, are received by the photocells 115 which are arranged behind the openings 1111 of the protecting plate. The release of the hollow explosive charges arranged as individual charges according to the example of FIG. 3 occurs when a projectile which penetrates the barrier plane cuts two rays which extend perpendicular to each other. In doing so, the igniting mechanism gives at the same time a firing signal to a known igniting circuit (not shown). The igniting circuit is connected to the intercepting charge which is associated with the crossing point of the rays as in the other embodiments. Instead of prisms, the deflection of the light could also be effected by means of mirrors arranged in the boxes 119.

Although the descriptions of the different embodiments of a protective arrangement or intercept system and explosive charge thereof in accordance with the invention has been made in some detail, it should be appreciated that the invention is in no way limited to the arrangement shown in the various embodiments or to the construction of the individual parts of the protecting arrangement described. This applies both to the kind of ignition and the sequence of ignition, and both are not the subject matter of the present invention. In addition, the details of the kind of hollow explosive charge is not specifically set forth herein. One essential feature of the invention is the arrangement of a grid screen or scanning light ray barrier which, upon penetration by a projectile, causes ignition of one or several hollow explosive charges which are arranged behind a barrier plane in the same grid to cause a premature explosion of the projectile before impact on the target.

While specific embodiments of the invention have been shown and described in detail to illustrate the application of the inventive principles, it will be understood that the invention may be embodied otherwise without departing from such principles.

What is claimed is:

1. A protective system for a fortification such as a bunker, tank, airplane hangar and the like, comprising a plurality of explosive charges, means mounting said explosive charges in a grid pattern adjacent the fortification to be protected and oriented in a direction for firing outwardly away from the fortification along predetermined shooting lines, and sensing means at a location spaced outwardly from said charges in a direction away from the fortification including sensing actuating means in alignment with each charge, each sensing actuating means being connected to each charge with which it is in alignment for firing the associated charge upon sensing an incoming enemy warhead, whereby the explosion of said charge will cause the premature explosion of said warhead at a spaced location from the fortification, said explosive charges including a plurality of charges arranged in a plurality of rows, one behind the other, each of said rows including a supporting plate, the supporting plate between adjacent rows having shooting openings for permitting penetration of the solid matter of an explosive charge in the row therebehind on explosion thereof.

2. A protective system for a fortification such as a bunker, tank, airplane hangar and the like, comprising a plurality of explosive charges, means mounting said explosive charges in a grid pattern adjacent the fortification to be protected and oriented in a direction for firing outwardly away from the fortification along predetermined shooting lines, sensing means at a location spaced outwardly from said charges in a direction away from the fortification including sensing actuating means in alignment with each charge, each sensing actuating means being connected to each charge with which it is in alignment for firing the associated charge upon sensing an incoming enemy warhead, whereby the explosion of said charge will cause the premature explosion of said warhead at a spaced location from the fortification, a protective plate covering said explosive charges, said sensing means including a light source mounted behind said protective plate and a photoelectric cell mounted behind said protective plate, openings in said plate in alignment with said light source and said photoelectric cell, and reflecting means at locations spaced outwardly from said protective plate for reflecting light from said light source across said explosive charges and downwardly to said photoelectric cell.

3. A protective system for a fortification such as a bunker, tank, airplane hangar and the like, comprising a plurality of explosive charges, means mounting said explosive charges in a grid pattern adjacent the fortification to be protected and oriented in a direction for firing outwardly away from the fortification along predetermined shooting lines, sensing means at a location spaced outwardly from said charges in a direction away from the fortification including sensing actuating means in alignment with each charge, each actuating means being connected to each charge with which it is in alignment for firing the associated charge upon sensing an incoming enemy warhead, whereby the explosion of said charge will cause the premature explosion of said warhead at a spaced location from the fortification, a protective plate covering said explosive charges, said sensing means including a light source mounted behind said protective plate and a photoelectric cell mounted behind said protective plate, openings in said plate in alignment with said light source and said photoelectric cell, and reflecting means at locations spaced outwardly from said protective plate for reflecting light from said light source across said explosive charges and downwardly to said photoelectric cell, said explosive charges being mounted in at least one row behind said protective plate with their photoelectric cell at one end and a light receiving source at an opposite end.

4. A protective system for a fortification such as a bunker, tank, airplane hangar and the like, comprising a plurality of explosive charges, means mounting said explosive charges in a grid pattern adjacent the fortification to be protected and oriented in a direction for firing outwardly away from the fortification along predetermined shooting lines, sensing means at a location spaced outwardly from said charges in a direction away from the fortification including sensing actuating means in alignment with each charge, each actuating means being connected to each charge with which it is in alignment for firing the associated charge upon sensing an incoming enemy warhead, whereby the explosion of said charge will cause the premature explosion of said warhead at a spaced location from the fortification, mounting means for mounting said explosive charges and said sensing means at the forward end of a tank comprising a wedge-shaped frame member having forwardly extending plates carrying said explosive charges arranged in a plurality of planes extending sidewardly and rearwardly from directly ahead of the tank.

5. A protective system for a fortification such as a bunker, tank, airplane hangar and the like, comprising a plurality of explosive charges, means mounting said explosive charges in a grid pattern adjacent the fortification to be protected and oriented in a direction for firing outwardly away from the fortification along predetermined shooting lines, and sensing means at a location spaced outwardly from said charges in a direction away from the fortification, said sensing means forming a light barrier and including a plurality of spaced light sources arranged in a row on one side and a plurality of photocells in alignment with said light sources at an opposite side, and also a similar number of similarly arranged light sources and photocells on opposite ends forming light intersections in a grid pattern, each light intersection being in alignment with a respective one of each of said explosive charges, said photocells connected to each charge and including actuating means operable by the interruption of the intersection of said light sources by an incoming enemy warhead for firing the associated charge upon alignment with the intersection whereby the explosion of said charge will cause the premature explosion of said warhead at a spaced location from the fortification, and the grid pattern in which said charges are arranged in a substantially rectangular grid pattern with the charges spaced at substantially equal distances apart.

6. A protective system for a fortification such as a bunker, tank, airplane hangar and the like, comprising a plurality of explosive charges, means mounting said explosive charges in a grid pattern adjacent the fortification to be protected and oriented in a direction for firing outwardly away from the fortification along predetermined shooting lines, and sensing means at a location spaced outwardly from said charges in a direction away from the fortification, said sensing means forming a light barrier and including a plurality of spaced light sources arranged in a row on one side and a plurality of photocells in alignment with said light sources at an opposite side, and also a similar number of similarly arranged light sources and photocells on opposite ends forming light intersections in a grid pattern, each light intersection being in alignment with a respective one of each of said explosive charges, said photocells connected to each charge and including actuating means operable by the interruption of the intersection of said light sources by an incoming enemy warhead for firing the associated charge upon alignment with the intersection whereby the explosion of said charge will cause the premature explosion of said warhead at a spaced location from the fortification, and said means mounting said charges includes a net, said charges being held at the reticulations of said net.

7. A protective system for a fortification such as a bunker, tank, airplane hangar and the like, comprising a plurality of explosive charges, means mounting said explosive charges in a grid pattern adjacent the fortification to be protected and oriented in a direction for firing outwardly away from the fortification along predetermined shooting lines, and sensing means at a location spaced outwardly from said charges in a direction away from the fortification, said sensing means forming a light barrier and including a plurality of spaced light sources arranged in a row on one side and a plurality of photocells in alignment with said light sources at an opposite side, and also a similar number of similarly arranged light sources and photocells on opposite ends forming light intersections in a grid pattern, each light intersection being in alignment with a respective one of each of said explosive charges, said photocells connected to each charge and including actuating means operable by the interruption of the intersection of said light sources by an incoming enemy warhead for firing the associated charge upon alignment with the intersection whereby the explosion of said charge will cause the premature explosion of said warhead at a spaced location from the fortification, and said charges are mounted directly on the surface to be protected.

8. A protective system for a fortification such as a bunker, tank, airplane hangar and the like, comprising a plurality of explosive charges, means mounting said explosive charges in a grid pattern adjacent the fortification to be protected and oriented in a direction for firing outwardly away from the fortification along predetermined shooting lines, and sensing means at a location spaced outwardly from said charges in a direction away from the fortification, said sensing means forming a light barrier and including a plurality of spaced light sources arranged in a row on one side and a plurality of photocells in alignment with said light sources at an opposite side, and also a similar number of similarly arranged light sources and photocells on opposite ends forming light intersections in a grid pattern, each light intersection being in alignment with a respective one of each of said explosive charges, said photocells connected to each charge and including actuating means operable by the interruption of the intersection of said light sources by an incoming enemy warhead for firing the associated charge upon alignment with the intersection whereby the explosion of said charge will cause the premature explosion of said warhead at a spaced location from the fortification, and a protective plate covering said charges.

9. A protective system according to claim 8, wherein said protective plate has a shooting opening in alignment with each charge large enough to permit the passage of solid matter of said charge upon explosion thereof.

10. A protective system for a fortification such as a bunker, tank, arplane hangar and the like, comprising a plurality of explosive charges, means mounting said explosive charges in a grid pattern adjacent the fortification to be protected and oriented in a direction for firing outwardly away from the fortification along predetermined shooting lines, and sensing means at a location spaced outwardly from said charges in a direction away from the fortification, and sensing means forming a light barrier and including a plurality of spaced light sources arranged in a row on one side and a plurality of photocells in alignment with said light sources at an opposite side, and also a similar number of similarly arranged light sources and photocells on opposite ends forming light intersections in a grid pattern, each light intersection being in alignment with a respective one of each of said explosive charges, said photocells connected to each charge and including actuating means operable by the interruption of the intersection of said light sources by an incoming enemy warhead for firing the associated charge upon alignment with the intersection whereby the explosion of said charge will cause the premature explosion of said warhead at a spaced location from the fortification, and said explosive charges include a plurality of charges arranged in a plurality of rows, one behind the other.

11. A protective system for a fortification such as a bunker, tank, airplane hangar and the like, comprising a plurality of explosive charges, means mounting said explosive charges in a grid pattern adjacent the fortification to be protected and oriented in a direction for firing outwardly away from the fortification along predetermined shooting lines, and sensing means at a location spaced outwardly from said charges in a direction away from the fortification, said sensing means forming a light barrier and including a plurality of spaced light sources arranged in a row on one side and a plurality of photocells in alignment with said light sources at an opposite side, and also a similar number of similarly arranged light sources and photocells on opposite ends forming light intersections in a grid pattern, each light intersection being in alignment with a respective one of each of said explosive charges, said photocells connected to each charge and including actuating means operable by the interruption of the intersection of said light sources by an incoming enemy warhead for firing the associated charge upon alignment with the intersection whereby the explosion of said charge will cause the premature explosion of said warhead at a spaced location from the fortification, an outer protective covering casing having a cavity therein containing one of said explosive charges and a shooting opening defined in alignment with said explosive charge for facilitating the passage of solid matter therefrom.

12. A protective system according to claim 11, including an additional moisture barrier plate curved around the exterior of hollow charge casing.

13. A protective system according to claim 12, wherein said casing has a rear portion with a recess defined therein, a tubular element fitted into said recess and connected to said casing, and a ball member for mounting said charge and adapted to receive the end of said tubular member and pivotally support said tubular member with said charge for orienting said charge prior to fixation, said tubular member being welded to said ball member after said charge is properly oriented in a firing direction.

14. A protective system for a fortification such as a bunker, tank, airplane hangar and the like, comprising a plurality of explosive charges, means mounting said explosive charges in a grid pattern adjacent the fortification to be protected and oriented in a direction for firing outwardly away from the fortification along predetermined shooting lines, and sensing means at a location spaced outwardly from said charges in a direction away from the fortification, said sensing means forming a light barrier and including a plurality of spaced light sources arranged in a row on one side and a plurality of photocells in alignment with said light sources at an opposite side, and also a similar number of similarly arranged light sources and photocells on opposite ends forming light intersections in a grid pattern, each light intersection being in alignment with a respective one of each of said explosive charges, said photocells connected to each charge and including actuating means operable by the interruption of the intersection of said light sources by an incoming enemy warhead for firing the associated charge upon alignment with the intersection whereby the explosion of said charge will cause the premature explosion of said warhead at a spaced location from the fortification, a protective plate having a plurality of cavities formed therein, sais explosive charges being positioned in said cavities, each cavity having a shooting opening for the firing of the solid material of said charge therethrough.

15. A protective system for a fortification such as a bunker, tank, airplane hangar and the like, comprising a plurality of explosive charges, means mounting said explosive charges in a grid pattern adjacent the fortification to be protected and oriented in a direction for firing outwardly away from the fortification along predetermined shooting lines, and sensing means at a location spaced outwardly from said charges in a direction away from the fortification, said sensing means forming a light barrier and including a plurality of spaced light sources arranged in a row on one side and a plurality of photocells in alignment with said light sources at an opposite side, and also a similar number of similarly arranged light sources and photocells on opposite ends forming light intersections in a grid pattern, each light intersection being in alignment with a respective one of each of said explosive charges, said photocells connected to each charge and including actuating means operable by the interruption of the intersection of said light sources by an incoming enemy warhead for firing the associated charge upon alignment with the intersection whereby the explosion of said charge will cause the premature explosion of said warhead at a spaced location from the fortification, a protective plate comprising a plurality of plate elements each having a plurality of cavities arranged at spaced locations containing one of said explosive charges therein, said plates being concavely curved at one end and convexly curved at the opposite end and being interlocked with the next adjacent plate.

16. A protective system for a fortification such as a bunker, tank, airplane hangar and the like, comprising a plurality of explosive charges, means mounting said explosive charges in a grid pattern adjacent the fortification to be protected and oriented in a direction for firing outwardly away from the fortification along predetermined shooting lines, and sensing means at a location spaced outwardly from said charges in a direction away from the fortification, said sensing means forming a light barrier and including a plurality of spaced light sources arranged in a row on one side and a plurality of photocells in alignment with said light sources at an opposite side, and also a similar number of similarly arranged light sources and photocells on opposite ends forming light intersections in a grid pattern, each light intersection being in alignment with a respective one of each of said explosive charges, said photocells connected to each charge and including actuating means operable by the interruption of the intersection of said light sources by an incoming enemy warhead for firing the associated charge upon alignment with the intersection whereby the explosion of said charge will cause the premature explosion of said warhead at a spaced location from the fortification, and a protective plate made up of a plurality of plate elements of substantially rectangular configuration arranged in a curve so that the outer portions of adjacent plates form a separation, and means covering the separations formed between said plate elements.

17. A protective system according to claim 16, including a member extending into the wedge-shaped formations formed between respective plate elements.

* * * * *